US007810217B2

(12) United States Patent
Cory et al.

(10) Patent No.: US 7,810,217 B2
(45) Date of Patent: Oct. 12, 2010

(54) GIN SAW STAND WITH ADJUSTABLE SEED ROLL RETAINING MEMBER

(75) Inventors: Mark D. Cory, Columbus, GA (US); Jerry B. Scarborough, Salem, AL (US)

(73) Assignee: Cherokee Fabrication Co., Inc., Salem, AL (US)

( * ) Notice: Subject to any disclaimer, the term of this patent is extended or adjusted under 35 U.S.C. 154(b) by 243 days.

(21) Appl. No.: 12/206,482

(22) Filed: Sep. 8, 2008

(65) Prior Publication Data

US 2010/0058559 A1 Mar. 11, 2010

(51) Int. Cl.
*D01B 1/08* (2006.01)

(52) U.S. Cl. ..... 19/55 A; 19/55 R

(58) Field of Classification Search ..... 19/55 R, 19/61, 55 A

See application file for complete search history.

(56) References Cited

U.S. PATENT DOCUMENTS 4,433,454 A 2/1984 Salmon
4,967,448 A * 11/1990 Mizer ..... 19/40
4,974,294 A 12/1990 Vandergriff
5,524,325 A 6/1996 Pierce
6,061,875 A 5/2000 Laird

OTHER PUBLICATIONS

E.P. Columbus et al., "Gin Stands," Cotton Ginners Handbook, 1994, pp. 90-94, Agricultural Handbook 503, U.S. Dept. of Agriculture, Agriculture Research Service.

* cited by examiner

*Primary Examiner*—Shaun R Hurley
(74) *Attorney, Agent, or Firm*—Miller & Martin PLLC

(57) ABSTRACT

A saw type gin stand for separating cotton lint from seed cotton in which the improvement comprises one or more of the inwardly facing surfaces of the roll box being movably adapted to re-shape the roll box. Specifically the inner surface of the roll box door member and a seed roll retaining member are adjustable during operation of the gin to re-shape the shape of the gin to optimize performance and, when the breast is opened, to retain the seed roll within the roll box and prevent pieces of the seed roll from breaking off of the roll.

30 Claims, 6 Drawing Sheets

- Prior Art -

GIN SAW STAND WITH ADJUSTABLE SEED ROLL RETAINING MEMBER

FIELD OF THE INVENTION

This invention relates to a novel gin saw stand for ginning seed cotton. In particular, this invention relates to a gin saw stand having a powered roll box door and an adjustable seed roll retaining member that allow for adjustment of the shape of the roll box during operation of the gin saw stand and for automatic extension to retain the seed roll when the breast is opened.

BACKGROUND OF THE INVENTION

The process of picking cotton and removing seeds, trash and other foreign materials from the seed cotton is well known. Freshly picked seed cotton is transported from the field to a cotton gin. The cotton gin has apparatus for receiving the seed cotton, removing the seeds from the long cotton fiber or lint, cleaning the lint, and pressing the lint into bales for sale and further processing.

Central to this process is a saw type gin stand (referred to herein as a gin saw stand or gin). The gin saw stand separates the cotton fiber from the seeds. Before the seed cotton is fed into the gin saw stand, it is processed with other apparatus to remove heavier foreign materials such as rocks and larger sticks, etc., and dried to desired moisture levels. After drying and cleaning, the seed cotton is fed at a controlled rate into a gin saw stand. From the gin saw stand, the cotton fiber is next transported to lint cleaners for further cleaning or processing before bailing.

A commercial gin saw stand which is currently in use is shown in cross section in FIG. 1. Referring to the figure, conventional gin saw stands 10 typically comprise an inlet cotton chute 11 wherein the cotton is deposited. A gin saw cylinder 12, composed of a large number of spaced apart circular blades 13 rotating having serrated outer edges 15 about a common axis 14, is combined with operably associated ribs 26 positioned between the blades 13 of the saw in order to strip the lint from the seed.

Delivery of the seed cotton into contact with the teeth of the first saw is assisted by a rotating toothed cylinder, referred to as the picker roller 21, which throws the cotton from the inlet cotton chute 11 onto the saw 12. This picker roller 21 is generally positioned with its axis 22 approximately lateral to the axis 14 of the saw 12, with its outer periphery 23 spaced apart from the serrated outer periphery 15 or teeth of the saw 12. The locks of cotton are drawn upwardly by the saw 12, through a passage called the seed discharge shaft 31 and into the lower portion of a roll box 25 positioned above the axis 14 of the saw 12 where the seeds with attached cotton accumulate in a large mass. This mass of seeds and/or seed cotton is commonly referred to as the roll or seed roll (not shown in FIG. 1). Most of the interior of the seed roll is made up of lint-free seed, and the exterior primarily comprises partially ginned seed and un-ginned seed.

The roll box 25 is typically of somewhat distorted cylindrical configuration and its structure is shaped by the exposed, inwardly facing (relative to the roll box) surfaces of a plurality of different members of the gin saw stand 10, such as, in the illustrated example, the upper portions 26*a* of the ginning ribs 26, the upper rib support 34, one or more upper gin-side sheet members 38 (which may further comprise the inner surface 37 of door member 36), one or more concave partition or sheet members 39 of the breast 18 and adjustable sheet member 20. Prior art gin saw stands 10 did employ an adjustable sheet member 20 though previously such sheet members have had a very limited degree of actuation, limited to the function and path of travel as that obtained with the cam shaft assembly as discussed herein. Prior art sheet members 20 did not serve the function of retaining the seed roll with in the roll box as is accomplished by the greater range of motion of the seed roll retaining member of the present invention (discussed below).

In some prior art gin saw stands (not shown), the roll box may also comprise an alternate additional set of ginning ribs for one or more additional saw cylinders.

While the roll box door member 36 of some prior art gin saw stands 10 do not form part of the roll box 25, it is not uncommon for at least a portion of the roll box 25 to be formed by the concave inner surface 37 of the roll box door member 36 as illustrated in FIG. 1. Typically there is a gap or space 35 in the upper portion of the roll box 25 to allow the seed roll to be viewed or even touched as the gin is operating. It will be noted that at the gap 35, the seed roll will maintain its generally circular shape because the centrifugal force will tend for it to move horizontally at this point, but gravity and the cohesive qualities of the fibers within the exterior regions of the seed roll tends to pull it down.

As gin saw capacities have increased, gin saw stands have become wider. At the same time, the increased capacities and density of the seed rolls within these larger machines have resulted in the need for the reinforcement of the roll box surfaces shaping the seed roll. As a result, the surfaces forming the roll box, including the roll box door member 36, have been made sturdier and more rigid, and thus thicker and heavier. This has resulted in roll box doors 36 that are cumbersome and may require the efforts of two or more individuals to open.

The actual separation of the seed from lint takes place in the roll box 25 of the gin saw stand 10. In the prior art gin saw stand 10 illustrated in FIG. 1, a set of ribs, referred to as the ginning ribs 26, are located in the spaces between the blades 13 of the saw 12 at the downstream end of the roll box 25, and extend from a position above the periphery 15 of the saw 12 downward through the spaces between the blades 13 to near or below the bottom of the saw 12. Cotton fibers in the roll box 25 are caught by the teeth of the first saw and passed toward the ginning ribs 26. As the teeth of the saw 12 pass between the ginning ribs 26, they pull the lint from the seeds, which are too large to pass between adjacent ribs 26. The seed-free lint proceeds past the ginning ribs 26 where it is removed from the teeth of the blades 13 by the faster moving brushes of the doffing brush 27 and passed out of the gin stand 10 through the doffing outlet 29 for transferral to the lint cotton cleaners and/or the battery condenser and bailing press depending upon the design of the installation.

As the seeds in the seed roll become substantially free of lint or in a substantially completely "ginned" state, they are of appropriate size and character to pass gravitationally downward adjacent the ginning ribs 26 between the saw blades 13 through the seed discharge shaft 31 and into a seed collection area 32 in the front lower portion of the gin saw stand 10, to be picked up by the usual seed discharge screw conveyor 33 and delivered to the discharge point (not shown). Lint-free seeds are not held firmly within the surface of the seed roll and often escape the seed roll along the relatively sharp curve or bulge in the seed roll that is formed at the bottom of the seed roll over the seed discharge shaft 31 immediately prior to being pulled upward by the periphery 15 of the saw 12. The seed discharge shaft 31 is defined by the space between the ginning ribs 26 and the closest, lower breast-side edge 45 of the roll box 25. Note, however, that when the breast 18 is in the closed position, the blades 13 extend through the ginning ribs 26 and into the seed discharge shaft 31.

In contrast to the substantially lint-free seeds, seeds which retain cotton fibers thereon generally remain on the surface of the mass of seeds and seed cotton (the seed roll) in the roll box 25, awaiting to be caught by the saw 12 and repeat the ginning operation.

In some models of gin saw stands, one or more rotating agitators 75 transversely spanning the gin saw stand 10 substantially parallel to the axis 14 of the saw 12 and having a serrated outer edge or periphery 76, have been placed in the roll box 25 to assist the gin saw 12 in turning the roll of material within the roll box 25. Typically, such agitators 75 comprise a plurality of discs 77 about the agitator axis 78, said discs 77 having serrated teeth about the periphery 76 and being canted at an angle relative to the gin saw blades 13 to cause some side to side action within the seed roll. The agitator 75 spins in a direction counter to the direction of the spinning saw 12. The agitator 75 is typically not located in the exact center of the roll box cavity 25, but is somewhat offset, and its periphery 76 is closer to the periphery 15 of the saw 12 than to the other surfaces defining the roll box 25. In some designs (not shown in FIG. 1), the agitator axis 78 further comprises or may be replaced by a perforated tube containing an auger which provides an additional path for seed to leave the seed roll.

The gin stand 10 typically comprises a casing or housing comprising a main gin frame 17 supporting the gin saw cylinder 12 and doffing brush 27, and a separable front, forwardly movable breast 18 including inlet cotton chute 11 and the supports for ginning ribs 26, picker roller 21, roll box door member 36, and (if any) agitator 75, permitting the breast structure 18 to be drawn away from the main gin frame 17. The breast 18 is typically attached to the main gin frame 17 in such a manner that it may be pulled away from the frame 17. In the prior art gin saw stand 10 shown in FIG. 1, the breast 18 is moved away from the frame 17 substantially laterally along the surface of an integrated rail or track 49 on opposing sides of the frame 17 by powered gears or a pneumatic cylinder (not shown in FIG. 1) or other common means. Another typical configuration is shown in FIG. 2 wherein the breast 18 is attached to the frame 17 at a pivot point 19 located near the front bottom of the main gin frame 17 so that the breast 18 may be tilted away from the main gin frame 17, thereby creating greater space between the breast 18 and the main gin frame 17 at the top of the breast 18 than at the lower regions. The breast 18 is typically attached to the main gin frame 17 at the top by a pneumatic or hydraulic cylinder 47 to power the movement of the breast between a fully-open, non-ginning position and closed, ginning position.

Moving or tilting the breast 18 or otherwise withdrawing it from the main gin frame 17 may be used as a method of interrupting the ginning process instead of stopping the saw 12 from turning. As the breast 18 is withdrawn to a fully-open position, the ginning ribs 26 move even with, or preferably beyond or outside the periphery 15 of the saw 12, thereby preventing the saw cylinder 12 from removing lint from the seed roll 25. This is important because it is much more efficient to simply move the breast 18 away from the main gin frame 17 than to stop the relatively massive saw cylinder 12 from spinning, then having to bring it back up to speed when the ginning process is to be re-started. As a practical matter, it is impossible to restart a motionless saw 12 with a full seed roll if the breast 18 is in the ginning position. The saws will encounter so much resistance, that the motor cannot start without over loading the motor starter.

Over the years, the capacities of gin saws 12 have increased, with the stands becoming wider and wider and with higher density seed rolls. As capacities have increased, the width of the seed discharge shaft 31 between the ginning ribs 26 and the lower, breast-side edge 45 of the roll box 25 immediately above the picker roller 21 has also increased to allow more cotton into the roll box and more ginned seed out. A drawback to this approach is that when the breast 18 is moved away from the main gin frame 17, an relatively larger open gap is created between the lower, breast-side edge 45 of the roll box 25 and the ginning ribs 26 as the blades 13 of the saw 12 are withdrawn from between the ginning ribs 26. When in operation, this gap is occupied by the portion of the saw blades 13 that extends through the ginning ribs 26 and the spin of the saw blades 13 provides an upward current in the mass of seeds and seed cotton in the roll box such that there is little likelihood that seed cotton will fall down the seed discharge shaft 31. However, as progressive models of saw stands have moved the lower, breast-side edge 45 of the roll box 25 higher and higher above the picker roller 21 to allow for greater cotton flow, the width of the open gap created when the breast 18 is opened has also increased because as seen in FIG. 1, the ginning ribs 26 typically have a curvature that mirrors an arc of the periphery 15 of the circular saw blades 13. Therefore, the higher the bottom edge 45 of the seed box 25 is positioned relative to the periphery 15 of the saw 12, the further the ginning ribs 26 curve away from the bottom edge 45 at that same relative height.

The larger gaps created when the breast 18 is opened combined with the bigger and more dense seed rolls in current gin saw stands, has led to an increase in the occurrence of seed roll breakage, with parts of the roll, and sometimes even the entire seed roll, including un-ginned seeds with usable cotton, breaking off and falling into the seed discharge shaft 31 when the breast 18 is opened because it is no longer supported by the saw 12 or the lower edge 45 of roll box 25 and/or seed vanes 40 (if any). Obviously, the loss of un-ginned cotton down the seed discharge shaft 31 is undesirable in that it is either wasted or reclaiming it requires a separate operation, resulting in lower productivity and higher expense.

Efforts have been made in the past to manipulate the shape of the roll box for the purpose of accelerating the removal of fully ginned seed from the seed roll. An example is shown in U.S. Pat. Reg. No. 4,974,294 issued to Vandergriff entitled Cotton Gin Seed Vanes and Seed Roll Box, wherein a set of spaced-apart vanes are attached to an adjustable finger shaft thereby allowing for the increased width of the seed passage which aids in increasing the rate of discharge of ginned seeds. The vanes extend from the finger shaft mounted across the breast below the bottom edge of a flat or planar surface of the roll box. The vanes extend from the breast into the seed passage when the breast is closed for operation to prevent the seed roll from sagging too deeply into the seed passage and to purposefully slice into the seed roll with the intent of rupturing the lint-covered surface of the seed roll to more easily allow ginned seeds from the interior of the seed roll to escape. The vanes are spaced apart on the finger shaft to allow ginned seed to fall between them down through the seed passage.

A thorough description of a variety of commercially available gin saw stands and their operation is provided by Anthony and Mayfield (ed.), Cotton Ginner's Handbook, Agricultural Handbook No. 503, United States Department of Agriculture, Agricultural Research Service, Washington, D.C., 1994, the contents of which are incorporated in their entirety by reference herein.

SUMMARY OF THE INVENTION

The present invention relates to a novel gin saw stand having a roll box, the shape of which may be adjusted during operation of the gin saw. Adjustment is possible through movement of one or more members making up one or more segments of the roll box surface. Specifically, the present invention provides a power operated roll box door that may be moved and stopped at any point between fully-opened and fully-closed positions. The roll box door may be adjusted manually or may be operatively connected to a powered means for movement. The present invention also proves a seed roll retaining member that many be adjusted during operation of the gin saw to re-shape the roll box. The seed roll retaining member may be adjusted manually or may be operatively connected to a powered means for movement.

The seed roll retaining member is further biased to extend to its fullest extent towards the cylindrical saw when the breast of the gin saw stand is opened to provide support for and substantially retain the seed roll in place above the saw. When closed, the seed roll retaining member is not extendable to the maximum extent, and is only capable of such extension when the breast is opened.

It is therefore an object of the present invention to provide an improved gin saw stand having a roll box with one or more surfaces that are adjustable to reconfigure the size of the roll box during ginning operations.

It is another object of the present invention to provide a gin saw stand having a powered roll box door positionable anywhere between its fully-opened and fully-closed positions.

A further object of the present invention is to provide a gin saw stand having a roll box retainer member which is adjustable during ginning operations to modify the shape of the roll box and which automatically extends even further into the seed discharge shaft to provide support for the seed roll when the breast is opened.

Another object of the present invention is to provide a gin saw stand having a cam shaft assembly allowing for fine adjustment of the seed roll retaining member to enhance the performance of the gin saw by adjusting the width of the seed discharge shaft.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
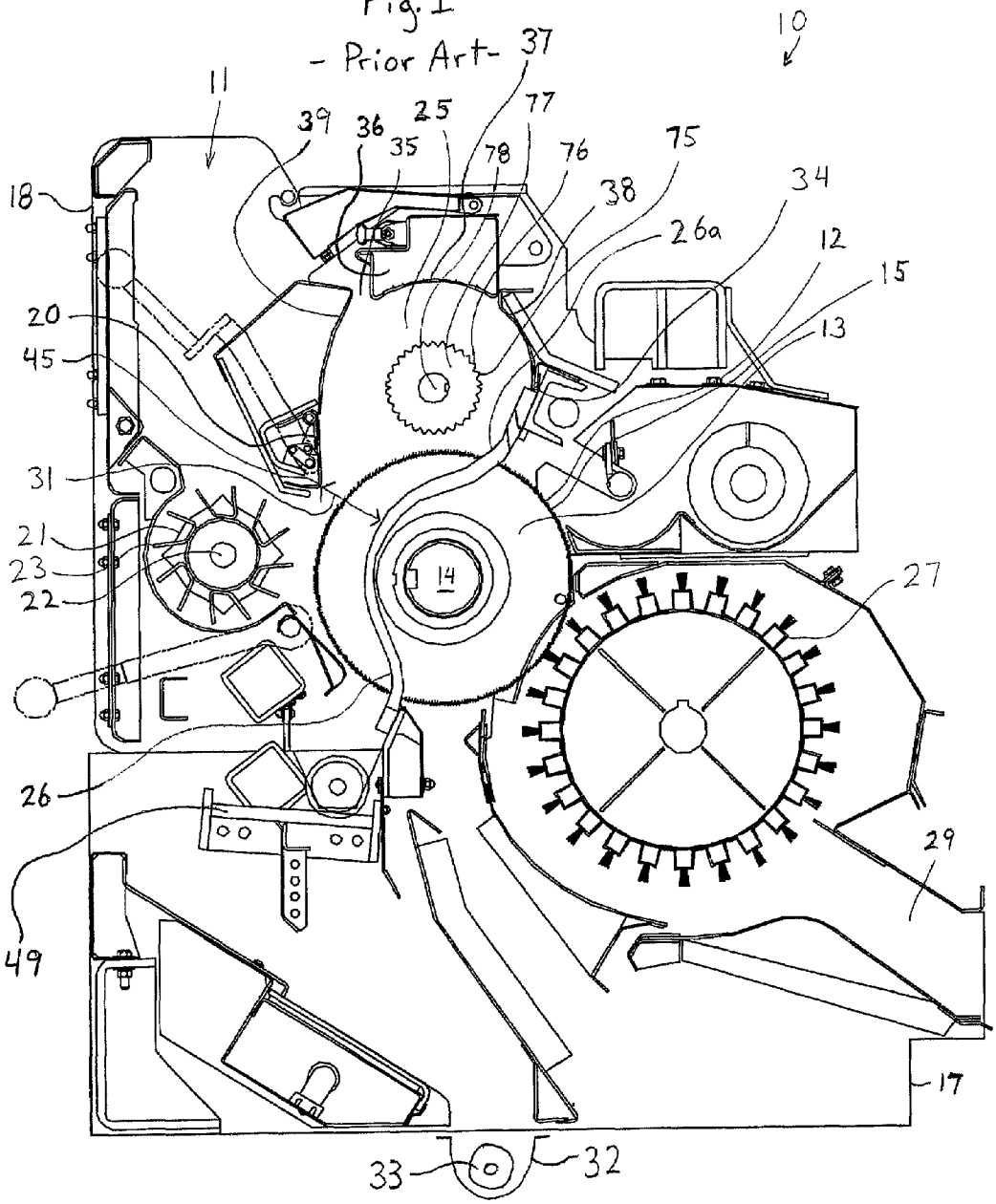
FIG. 1 is a side cross section view of a conventional gin saw stand of the prior art.
Figure 2:
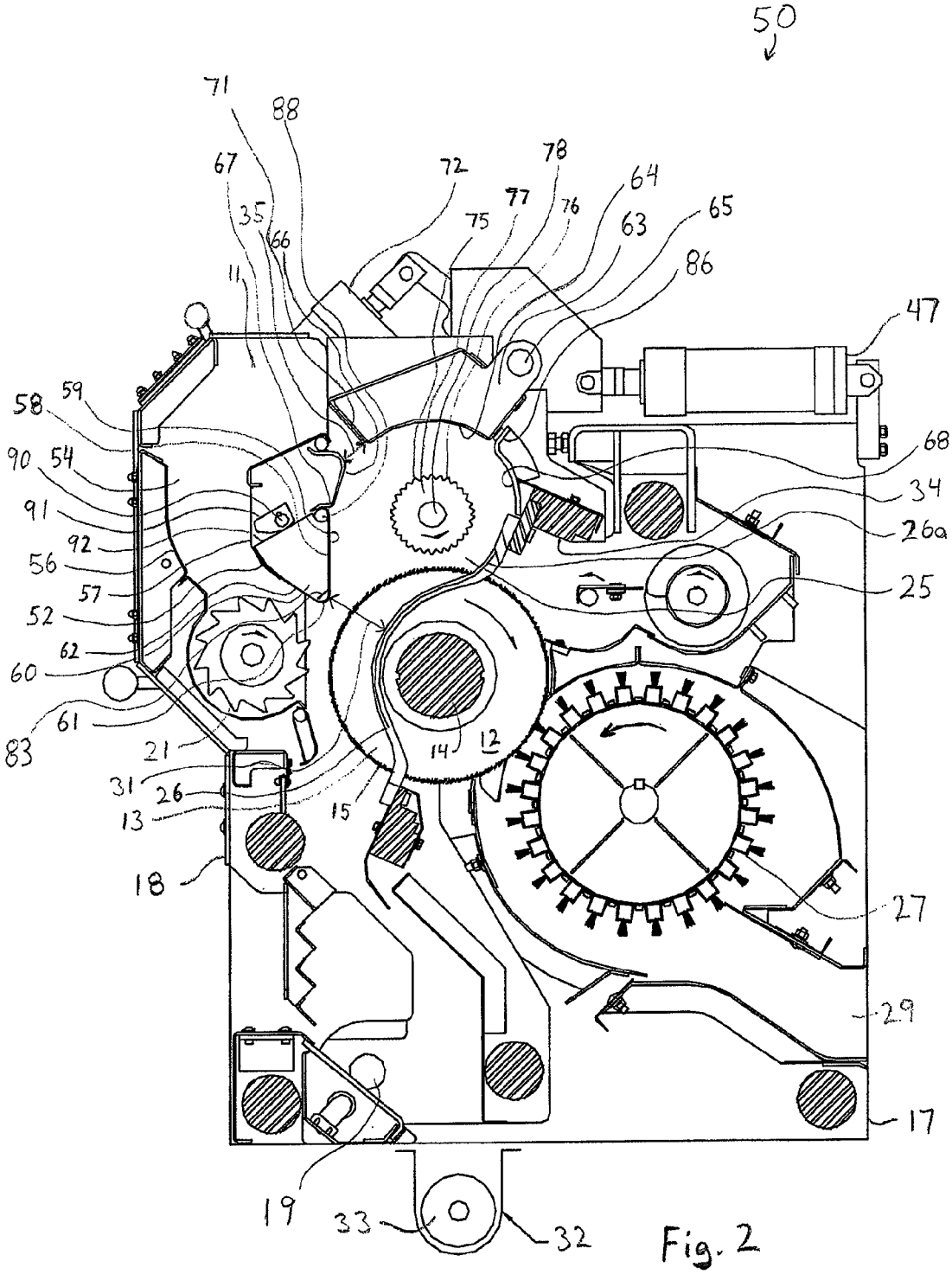
FIG. 2 is a side cross section view of the gin saw stand of the present invention.

As illustrated in FIG. 2, the gin saw stand of the present invention 50 comprises an inlet cotton chute 11 wherein the seed cotton is deposited leading to a picker roller 21 which assists in guiding the seed cotton against the periphery 15 of the circular blades 13 of cylindrical saw 12. The inlet cotton chute 11 is defined within the breast 18 of the gin saw stand 50 by rear and front panels 56 and 57, respectively, transversely spanning the breast 18 and first 54 and second breast side panels 55 (shown in FIGS. 8 and 9) of the breast 18.

The picker roller 21 throws the seed cotton in the inlet cotton chute 11 against the outer periphery 15 or teeth of the saw 12 which draws the locks of cotton upward through the seed discharge shaft 31 and into the lower portion of the roll box 25 positioned above the axis 14 of the saw 12 where the seeds with attached cotton accumulate into the seed roll. In the present invention, the seed discharge shaft 31 is defined by the space or shortest distance between the ginning ribs 26 and the curved bottom elbow 61 of the seed roll retaining member 60. As illustrated in FIG. 2, when the breast 18 is in the closed position, as it is during ginning operations, the blades 13 of the saw 12 extend through the ginning ribs 26 and into the seed discharge shaft 31.

As previously discussed, seed cotton remains circulating within the roll box 25 until the ginning action of the saw 12 and ginning ribs 26 remove substantially all of the cotton lint from the seeds. The lint is pulled from the seeds through the ginning ribs 26 where it is removed from the teeth of the saws by the doffing brush 27 and passes out of the gin stand 50 through the doffing outlet 29. Contemporaneously, as the seeds in the seed roll become substantially free of lint, they are no longer held within the surface of the seed roll and may fall out of the bottom of the seed roll, passing gravitationally through the seed discharge shaft 31 and into a seed collection area 32 in the front lower portion of the gin saw stand 50.

As in the prior art, the roll box cavity 25 of the present invention is of a somewhat distorted cylindrical configuration, however, unlike in prior art gin saw stands 10, one or a plurality of the plurality of exposed, inwardly facing surfaces that shape the roll box cavity 25 are adapted to be moved to re-shape the roll box cavity 25, and thus the seed roll formed within it, while the gin saw stand 50 is actively ginning the seed cotton of the seed roll. In a presently preferred embodiment, the roll box cavity 25 is defined by a plurality of exposed, inwardly facing (relative to the roll box) surfaces, namely, the upper portions 26*a* of the ginning ribs 26, the inner surface member 68 of upper rib support 34, the concavely curved inner surface 64 of roll box door member 63, one or more upper breast sheet members 66 and the inner surface 59 of the proximal end 58 of the seed roll retaining member 60. In the roll box 25 of the present invention 50, a gap 35 exists between the outer end 71 of the door member 63 and the upper sheet member 66 of the breast 18.

Door member 63 is hinged to the breast 18 at one or more pivot points, such as a transversely spanning shaft or axis 65. Door member 63 rotates about the pivot point between a fully-closed position and a fully-opened position. Means for moving and holding the door member at any position between the fully-closed and fully-opened positions is provided, such as pneumatic door cylinder 72 attached to the shaft 65 on the outside 54 of breast 18. Alternate means for moving the door, such as a hydraulic piston or powered gears or other conventional motors are within the contemplation of this invention. Preferably, the door member 63 is capable of movement through an arc of between about 40 to about 60 degrees between the fully-opened and fully-closed positions, though greater ranges of motion up to about 180 degrees are potentially possible. When in the fully-closed position as illustrated in FIG. 2, door member 63 rests against the upper end 86 of upper rib support 34 or the inner surface member 68 of rib support 34.

The seed roll retaining member 60 transversely spans the breast 18 of the gin saw stand 50 substantially parallel to the axis 14 of the saw 12. The seed roll retaining member 60 is a substantially continuous surface or sheet transversing the breast 18 without perforations, gaps or breaks, and is typically formed of sheet metal, though it may be formed of any suitable substantially rigid material. A first end of the proximal end 58 of the seed roll retaining member 60 is pivotably attached to the breast 18 at one or more pivot points such as transversely spanning seed roll retaining member axis 88 (also referred to herein as the integral shaft). The pivot point 88 is positioned immediately below the lower end 67 of breast sheet member 66 such that the inner surface 59 of the breast sheet member 66 and the inner surface of the proximal end 58 of the seed roll retaining member 60 form a relatively continuous surface of roll box 25.

Seed roll retaining member 60 further comprises an elbow end 61, preferably rounded, at the opposing second end of the proximal end 58 opposite the pivot point 88, forming an angle between the proximal end 58 and the distal end 62. The distal end 62 is angled relative to the proximal end 58 such that it remains in slidable contact with the lower end 52 of rear panel 57 of breast 18, preferably the rear surface of the lower end 52 so that there is a relatively smooth transition between the lower end 52 and the distal end 62 of the seed roll retaining member 60. Maintaining contact between the seed roll retaining member 60 and the lower end 52 of the rear panel 57 of the cotton inlet chute 11 at all times, regardless of whether the seed roll retaining member 60 is in the fully-extended or fully-retracted position or anywhere in between is important to present a continuous surface that blocks seed cotton from being thrown up behind the seed roll retaining member 60 when it is extended and thereby preventing the seed cotton from becoming trapped under the seed roll retaining member 60 and potentially clogging or inhibiting the free rotation of the seed roll retaining member 60 during operation of the gin.

In the preferred embodiment of the present invention 50, the proximal end 58 and distal end 62 of the seed roll retaining member 60 are spaced-apart members rather than opposite sides of a solid member to reduce overall weight. One or more substantially triangular or pie-shaped supports 92 are spaced along the length of the seed roll retaining member 60 between the proximal end 58 and distal end 62 to maintain the shape of the seed roll retaining member 60 by keeping the proximal end 58 and distal end 62 separated. An opposing pair of outermost supports 92 are positioned flush with the ends of the seed roll retaining member 60 which are, in turn, substantially flush with the sides 54, 55 of the breast 18. In a preferred embodiment, each support 92 has a chamfer 83 or blunted point proximate to where it fits into the elbow 61 to avoid the necessity of meeting fine tolerances when assembling the seed roll retaining member 60.

In an alternate embodiment not shown in FIG. 2, the seed roll retaining member 60 could be formed as a solid piece with the outward surface 59 of proximal end 58 and distal end 62 being merely the different sides of a solid member. However, based on currently used materials, a solid seed roll retaining member 60 would be unnecessarily heavy and not practicable. Similarly, another alternative not illustrated is to form the seed roll retaining member 60 as a substantially triangular tube.

Figure 4:
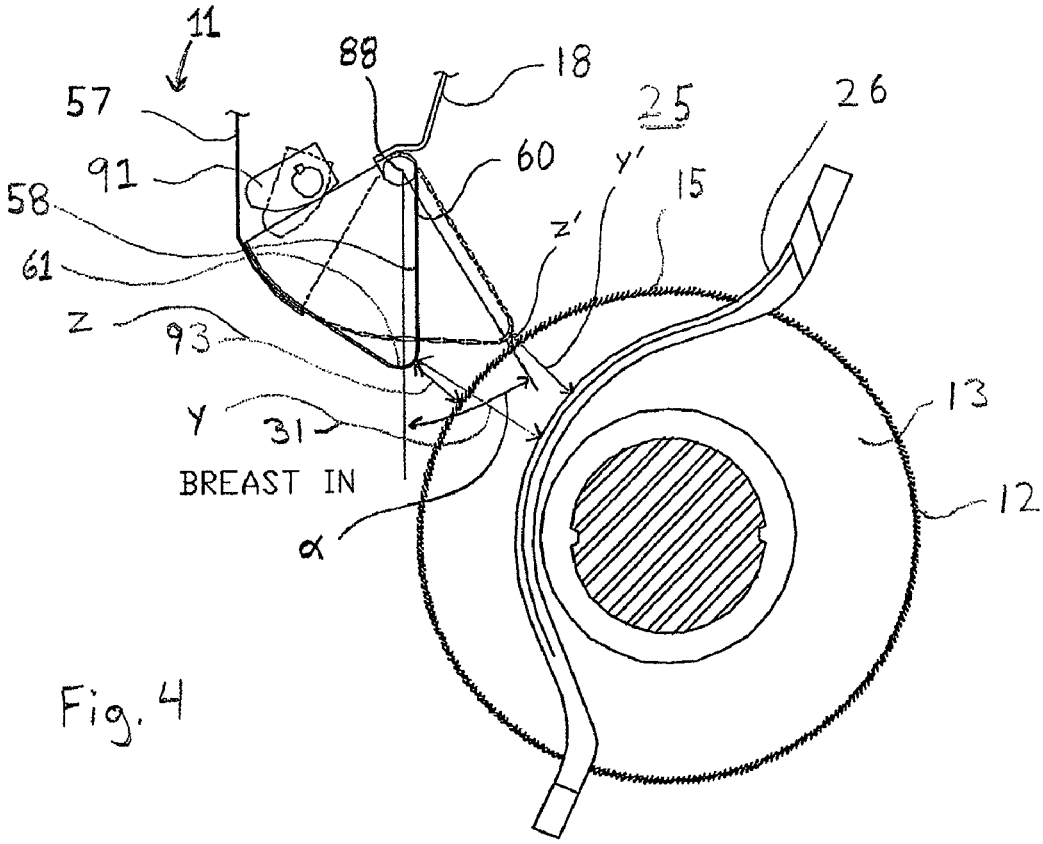
FIG. 4 is a side cross section of a portion of the breast and saw of a less preferred embodiment of the present invention with the breast in the ginning or closed position illustrating the full range of motion of the seed roll retaining member utilizing the integral shaft of the seed roll retaining member.

As illustrated in FIG. 4, the seed roll retaining member 60 is rotatably attached to the axis 88 so that it may rotate between a first, fully-retracted position (illustrated in solid lines) and a second, fully-extended position (illustrated in dashed lines) through an arc ($\alpha$) of between about 20 degrees to about 40 degrees.

Figure 9:
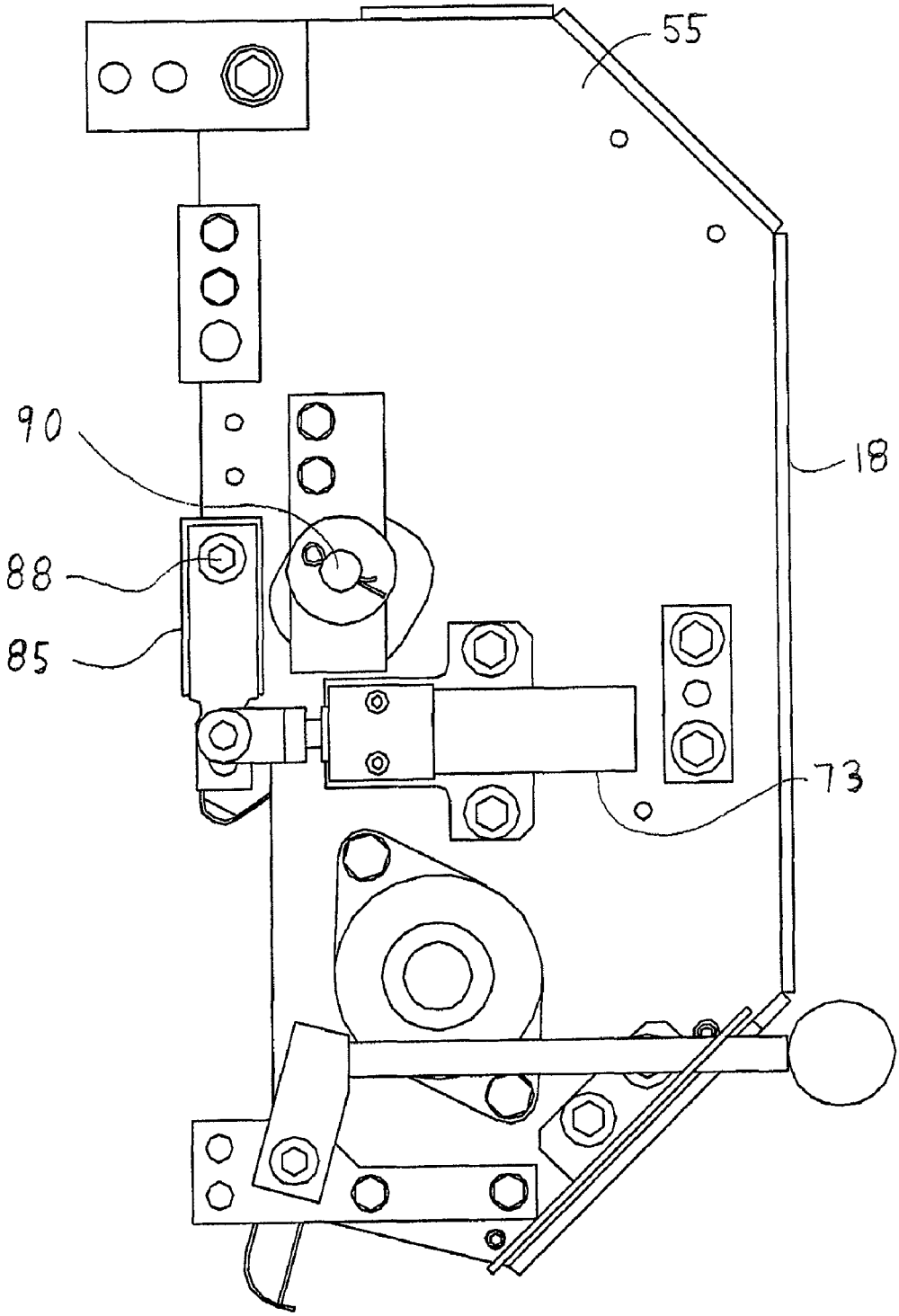
FIG. 9 is a left side view of the breast of the present invention.

As illustrated in FIG. 9, means for moving and holding the seed roll retaining member 60 at any position between the fully-retracted and fully-extended positions is provided, such as retainer pneumatic cylinder 73 linked to the integral shaft 88, such as by lever 85. Retainer pneumatic cylinder 73 is preferably a fairly small bore cylinder and its normal state is retracted, thereby tending to keep the seed roll retaining member 60 in its fully-retracted position and its internal supports 92 engaged with the cams 91 of the cam shaft assembly 89.

As shown in FIG. 2, the gin saw stand 50 further comprises a cam shaft assembly 89 for moving the seed roll retaining member 60, particularly during ginning operations. The cam shaft assembly 89 comprises a cam shaft 90 transversing the breast 18 with an axis parallel to the integral shaft 88 of the seed roll retaining member 60. One or more lobed or oblong cams 91 are carried upon the cam shaft 90 with each cam 91 normally in sliding contact with the seed roll retaining member 60, preferably with an associated support 92 of the seed roll retaining member 60. Turning the cam shaft 90 causes the lobe of the cam 91 to push upon the associated support 92 of the seed roll retaining member 60, thereby moving the seed roll retaining member 60 between a normal fully-retracted position and a partially-extended position (illustrated in dashed lines in FIG. 3).

Figure 7:
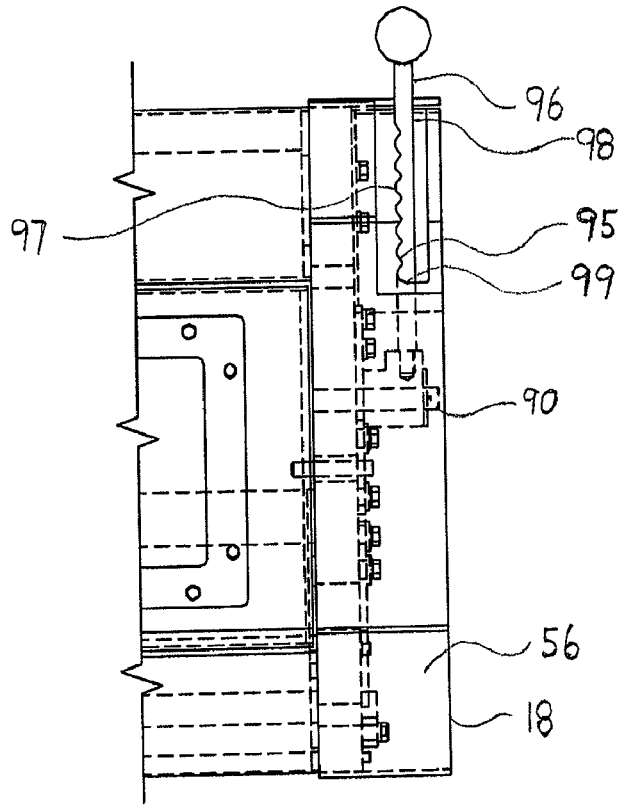
FIG. 7 is a partial right side front view of the breast of the present invention.
Figure 8:
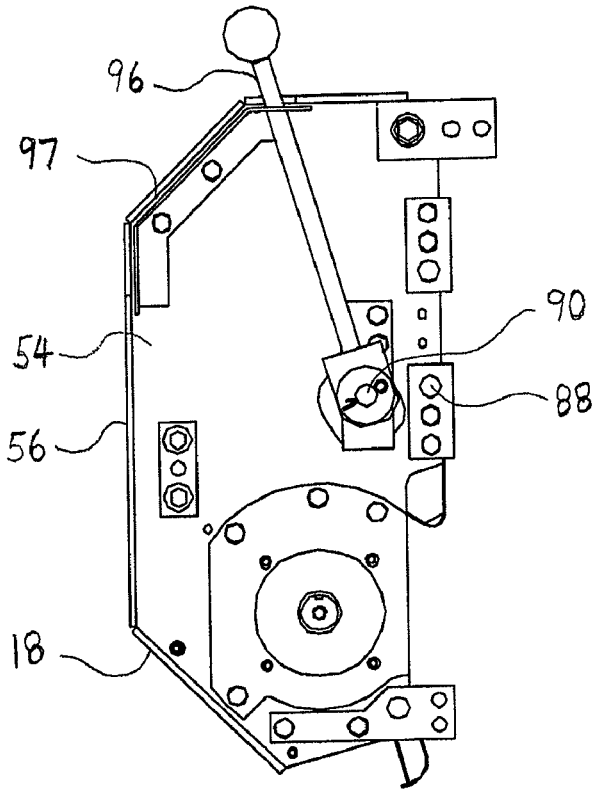
FIG. 8 is a right side view of the breast of the present invention.

As best illustrated in FIGS. 7 and 8, a means for moving the seed roll retaining member 60 via the cam shaft assembly 89 is provided, such as cam shaft lever 96 operatively attached to the cam shaft 90 and extending through a detented slot 97 in the front panel 56 of breast 18. The means for moving the cam shaft assembly may be operated manually or by connection to some other power source such as a motor or pneumatic cylinder (not shown). In a preferred embodiment, lever 96 may be manually moved along the length of the slot 97 from a first end 98 to opposing second end 99 and stopped and held in each detention 95 of the slot 97. When the lever 96 is positioned at one end 98 of the slot 97, the seed roll retaining member 60 is positioned in the corresponding fully-retracted position, and when the cam shaft lever 96 is positioned at the other end 99, the seed roll retaining member 60 is positioned in the corresponding partially-extended position. Catching the lever 96 in detensions 95 along the slot 97 positions the seed roll retaining member 60 at corresponding positions between the fully-retracted and the partially-extended positions. Preferably, the cam shaft lever 96 cannot be used to position the seed roll retaining member 60 in the fully-extended position, the limit of its extension by means of the lever 96 being the partially-extended position intermediate the fully-retracted position and fully extended position.

Figure 3:
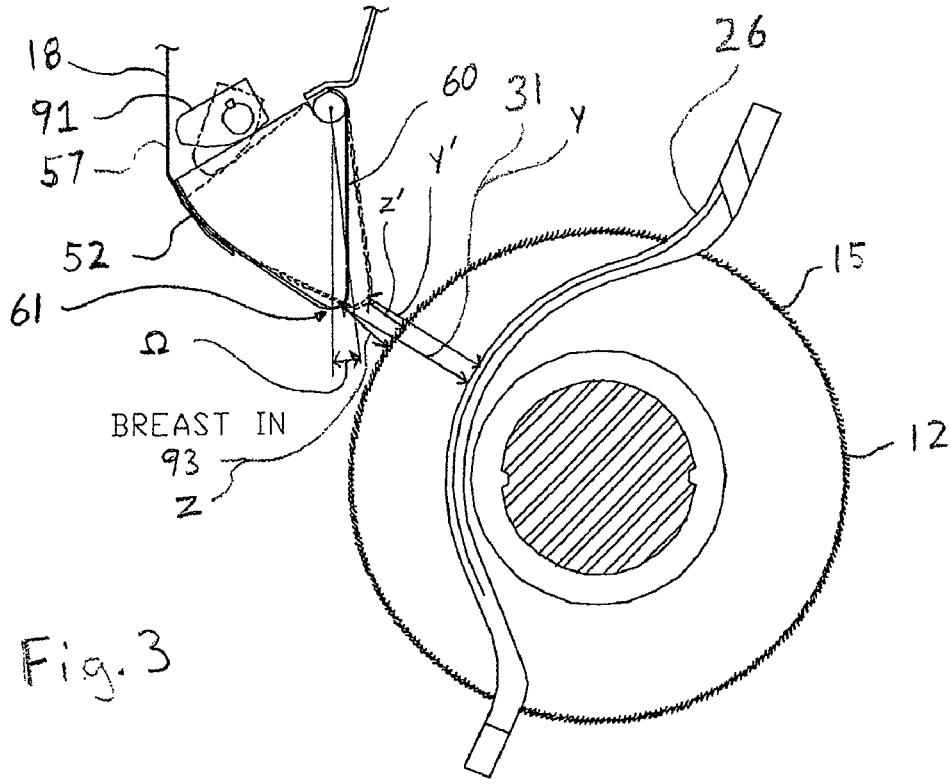
FIG. 3 is a side cross section of a portion of the breast and saw of the present invention with the breast in the ginning or closed position illustrating the range of motion of the seed roll retaining member utilizing the cam and cam shaft mechanism.

As illustrated in FIG. 3, the seed roll retaining member 60 may be moved via the cam shaft assembly through an arc Ω of between about 5 degrees to about 10 degrees. The magnitude of the adjustment may be changed by increasing or decreasing the size of the lobe of the supports 92 and by limiting or extending the range of motion of the cam shaft lever 96 within the slot 97 or a combination of both. Alternate means for moving the cam shaft assembly and thereby the seed roll retaining member 60, such as a hydraulic piston or powered gears or other conventional motors are also within the contemplation of this invention.

In an alternative embodiment, the function served by cam shaft assembly could be accomplished by moving the seed roll retaining member 60 during ginning operations using pneumatic cylinder 73 attached to the integral shaft 88. The cylinder 73 may be equipped with a linear positioning device providing exact piston location within the cylinder and a control panel on the gin 50 configured to provide an adjustment range similar to the range available using the manual lever 96. Another potential method of moving the seed roll retaining member 60 during ginning operations would be the use of a ball screw actuator equipped with a rotary encoder. Other means common in the art are also within the contemplation of this invention, but are not as favored as the cam shaft assembly 89 due to increased costs.

In one preferred embodiment, the seed roll retaining member 60 is configured such that it can only be moved into the fully-extended position by the retainer pneumatic cylinder 73 but not cam shaft assembly. Allowing the positioning of the seed roll retaining member 60 into the fully-extended position using the manual lever 96 of the cam shaft assembly or other means may be potentially disadvantageous because, as shown in FIG. 4, with the breast 18 in the operative, ginning position, fully extending the seed roll retaining member 60 would substantially close off or restrict the unobstructed portion of the seed discharge shaft 31 not occupied by the blades 13 of the saw 12, said open span being referred to herein as the open shaft span 93. Substantially restricting or closing off the open shaft span 93 of the seed discharge shaft 31 also substantially closes off or restricts the path for new seed cotton as it is pulled upward by the periphery 15 of the saw 12 into the roll box 25. If the width of the open shaft span 93 is too restricted or made too small, seed cotton in the gin 50 will tend to choke or clog up at that point, leading to extremely undesirable results and, potentially, failure of the gin 50. Accordingly, the cam shaft assembly is preferably mechanically restricted by an appropriate physical limiting structure so that it cannot be used to move the seed roll retaining member to the fully-extended position when the breast 18 is closed, such as by limiting the size of the lobes of the cams 91 or restricting the movement of the cam shaft lever 96. Similarly, the pneumatic cylinder 73 cannot be operated to fully extend the seed roll retaining member 60 when the breast 18 is closed. Only contemporaneously with or after the flow of seed cotton into the inlet cotton chute 11 has been cut off, which will result in substantially all of the seed cotton in the chute 11 being drawn up into the roll box 25 within a matter of a few seconds, may the breast 18 begin the process of being drawn away from the saw cylinder 12 by the pneumatic breast cylinder 47.

As best shown in FIG. 3, the present invention 50, the seed discharge shaft 31 is defined by the distance (y) between the ginning ribs 26 and the elbow 61 of the seed roll retaining member 60, and the open shaft span 93 is defined by the distance (z) between the elbow 61 and the periphery 15 of the saw cylinder 12. The ability to manipulate or vary the width of these distances, both when the breast 18 is opened and when it is closed, is an essential goal of the present invention because even relatively slight adjustments to these distances can generate tremendous performance enhancement in the operation of the gin 50 and substantially reduce the loss of unginned seed cotton when the breast 18 is opened. In particular, the ability to extend the seed roll retaining member 60 to within a few inches of the ginning ribs 26 when the breast 18 is open is a substantial improvement not accomplished in the prior art.

When the breast 18 is closed and the seed roll retaining member 60 is positioned in the fully-retracted position, the width (y) of the seed discharge shaft 31 is about 3.5 inches (about 8.9 cm) and the width (z) of the open shaft span 93 is about 1.5 inches (about 3.8 cm). When the breast 18 is closed, the distance (z) of primary importance is the open shaft span 93, and the width (y) of the seed discharge shaft 31 is of only secondary importance because in different models of gin saw stands, the distance the saw blades 13 extend past the ginning ribs at this closest point my vary. Variations in the shape or contour of the ginning ribs 26 proximate to this point may also result in differences in the width (y) of the seed discharge shaft 31, but the operational improvements result from the ability to vary the width (z) of the open shaft span 93.

When the breast 18 is closed and the seed roll retaining member 60 is extended to the greatest extent possible by manual adjustment with the cam shaft lever 96 (i.e., an intermediate partially-extended position) as shown in FIG. 3 in dashed lines, the width (z') of the open shaft span 93 is about 15/16 inches (about 2.4 cm) and the width (y') of the seed discharge shaft 31 is about 3 inches (about 7.6 cm).

FIG. 4 illustrates a non-preferred embodiment in which the seed roll retaining member 60 is configured to extend to its fully-extended position when the breast 18 is closed. In such a configuration, the width (z') of the open shaft span 93 is about 3/16 inches (about 0.5 cm) and the width (y') of the seed discharge shaft 31 is about 2 inches (about 5.1 cm). However, as previously discussed, reducing these widths to such an extent tends to result in clogs and blockage of the open shaft span 93 and seed discharge shaft 31. Even in such a configuration, when the breast 18 is closed, meaning the blades 13 of saw 12 are extended to the fullest extent between the ginning ribs 26, the proximal end 58 must not be of such a length that the elbow 61 would come into contact with the periphery 15 of the blades 13. In other words, the elbow 61 can be configured to pass extremely closely over the surface of the saw 12, but actual contact between the two should be physically impossible to avoid damage to the seed roll retaining member 60 and blades 13.

Preferably, the means for moving the seed roll retaining member 60 via the integral shaft 88 is configured to preclude it from reaching the fully-extended position except when the breast 18 is opened, and then preferably only when the breast 18 is also opened to its fullest extent. In a preferred embodiment, the seed roll retaining member 60 is biased to automatically extend to the fully-extended position when the breast 18 is opened, thereby automatically shortening the distance between the ginning ribs 26 and elbow 61 (i.e., the seed discharge shaft 31) to the fullest extent possible, and thereby providing additional support for the seed roll along the proximal end 58 of the seed roll retaining member 60 and substantially reducing the likelihood that significant portions of the seed roll within the roll box 25 will break away and fall through the seed discharge shaft 31 and into the seed collection area 32.

Biasing of the seed roll retaining member 60 to the fully-extended position when the breast 18 opens may be accomplished in many ways familiar in the art, such as simply programming pneumatic cylinder 73 to actuate in coordination with the actuation of the pneumatic cylinder 47 that moves the breast 18. Other means for mechanically biasing the seed roll retaining member 60 are within the contemplation of this invention, such as connecting a lever on roll retainer member 60 to a mechanical linkage actuated by the motion of the breast 18 drawing away from the saw 12. Alternately, and not by way of limitation, the retainer cylinder 73 may be linked or otherwise programmed to operate to extend the seed roll retaining member 60 to the fully-extended position only in tandem with the opening of the breast 18 by the breast cylinder 47.

Figure 5:
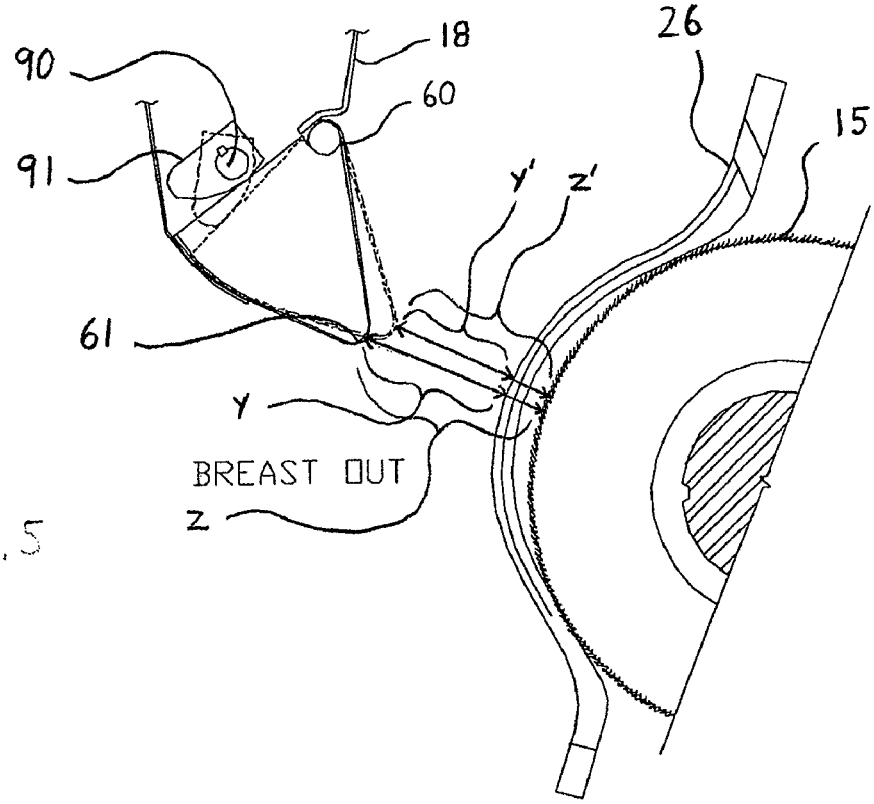
FIG. 5 is a side cross section of a portion of the breast and saw of the present invention with the breast in the open position illustrating the range of motion of the seed roll retaining member utilizing the cam and cam shaft mechanism.

When the breast 18 is open as shown in FIG. 5, the width (y) of the seed discharge shaft 31 is the tolerance of primary importance because the periphery 15 of the saw cylinder 12 is substantially withdrawn from between the ginning ribs 26 thereby completely clearing or removing any impediments from the seed discharge shaft 31. As a practical matter, it will be apparent that when the breast 18 is opened, the width (y) of the seed discharge shaft 31 and the width (z) of the open shaft span 93 are substantially identical. As stated above, the open shaft span 93 is defined as the portion of the seed discharge shaft 31 not occupied by the blades 13 of the saw 12. When the breast 18 is open, no material portion of the seed discharge shaft 31 is occupied by the blades 13.

As best illustrated in FIG. 4, when the breast 18 is in the fully-extended position, the internal supports 92 of the seed roll retaining member 60 are drawn away from contact with the associated cams 91, even if the cam shaft 90 is turned so that the lobe of the cams 91 would otherwise be extending the seed roll retaining member 60 to an intermediate position (as shown in dashed lines in FIG. 3). When the pneumatic cylinder 73 attempts to return the seed roll retaining member 60 to its normal fully-retracted state, as it is withdrawn, the supports 92 would come back into contact with the extended cams 91, and thus the seed roll retaining member 60 would remain in the position to which the cam shaft assembly is set, rather than returning to the fully-retracted state. Thus, during operation, once a desirable setting of the width (y)of the seed discharge shaft 31 has been achieved using the cam shaft assembly 89 to move the seed roll retaining member 60, the breast 18 can be opened, which results in the automatic movement of the seed roll retaining member 60 to its fully-extended position, then the breast 18 can be closed again and the seed roll retaining member 60 will assume the position last set by the cam shaft assembly 89 and does not require additional adjustment.

Figure 6:
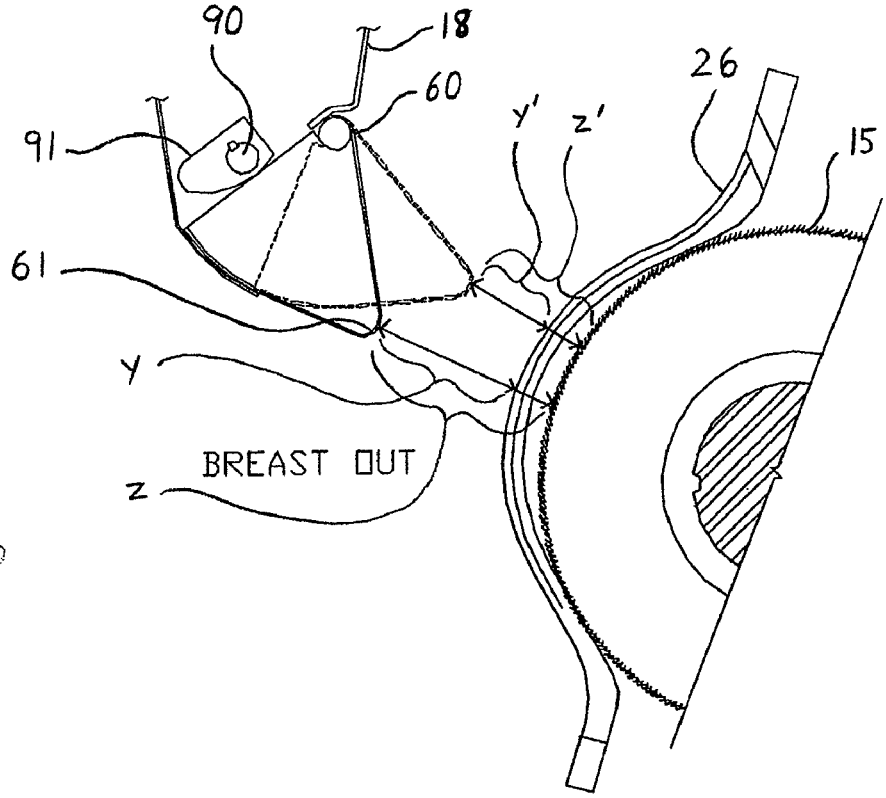
FIG. 6 is a side cross section of a portion of the breast and saw of the present invention with the breast in the open position illustrating the range of motion of the seed roll retaining member utilizing the integral shaft of the seed roll retaining member.

As shown in FIG. 6, when the breast 18 is opened and the seed roll retaining member 60 is in the fully-extended position (illustrated in dashed lines), the proximal end 58 has a length configured to result in a seed discharge shaft 31 having a width (y') of about 2.0 inches (about 5.1 cm) or less and the distance (z') between the elbow 61 and the periphery 15 of the saw 12 is about 2.5 inches (about 6.4 cm) or greater. Fully extending the seed roll retaining member 60 when the breast 18 is open serves the function of supporting the seed roll and preventing it, or portions thereof, from falling through the seed discharge shaft 31. This supportive function is not materially served when the seed discharge shaft 31 is greater than about 4¾ inches (about 12 cm) in width (y'); no meaningful support is provided when the seed discharge shaft 31 is more than about 6 inches (about 15 cm) in width (y'), with the seed roll or substantial parts thereof being lost the majority of the time at this width. When the breast 18 is opened and the seed roll retaining member 60 is in the fully-retracted position (illustrated in solid lines in FIG. 6), the width (y) of the seed discharge shaft 31 is about 3.5 inches (about 8.9 cm) and the distance (z) between the elbow 61 and the periphery 15 of the saw 12 is about 4.0 inches (about 10.2 cm) or greater.

As illustrated in FIG. 5, when the breast 18 is opened and the seed roll retaining member 60 is extended to the greatest extent possible by manual adjustment with the lever 96 (illustrated in dashed lines), i.e., the partially-extended position, the width (y') of the seed discharge shaft 31 is about 3.0 inches (about 7.6 cm) and the distance (z') between the elbow 61 and the periphery 15 of the saw 12 is about 3 7/16 inches (about 8.7 cm) or greater.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

Having thus set forth the nature of the invention, we claim:

1. A saw type gin stand for separating cotton lint from seed cotton comprising a gin saw cylinder having a plurality of spaced apart parallel circular blades rotating about a central axis, ginning ribs between said blades, a roll box adjacent to said gin saw cylinder, a movable breast positionable between a non-ginning position and a ginning position and having a substantially continuous surface, a seed roll retaining member attached to the breast substantially parallel to the axis of the saw cylinder, said seed roll retaining member extendable to within about 5 cm of the ginning ribs when the breast is in the non-ginning position.

2. The saw type gin stand of claim 1 further comprising a cam shaft assembly for moving the seed roll retaining member.

3. The saw type gin stand of claim 2 wherein the cam shaft assembly comprises a cam shaft transversely spanning the breast substantially parallel to the axis of the saw cylinder and one or more cams carried upon the cam shaft, each such cam in slidable contact with the seed roll retaining member.

4. The saw type gin stand of claim 2 wherein the cam shaft assembly further comprises a retaining member lever connected to the cam shaft assembly for manual movement of said seed roll retaining member.

5. The saw type gin stand of claim 1 wherein the seed roll retaining member comprises a proximal end attached to the breast at a pivot point and an elbow opposite the pivot point connecting the proximal end to a distal end, said distal end in slidable contact with the breast.

6. The saw type gin stand of claim 5 wherein one or more supports are spaced along the length of the seed roll retaining member between the proximal end and distal end to maintain the shape of the seed roll retaining member.

7. The saw type gin stand of claim 6 further comprising a cam shaft transversely spanning the breast substantially parallel to the axis of the saw cylinder and one or more cams carried upon the cam shaft, each such cam in slidable contact with an associated support of the seed roll retaining member.

8. The saw type gin stand of claim 1 wherein the seed roll retaining member is attached to the breast at an integral shaft and rotatable about said integral shaft between a fully-retracted position, through a plurality of intermediate positions, to a fully-extended position, wherein the seed roll retaining member may only be rotated to said fully-extended position when the breast is in the non-ginning position.

9. The saw type gin stand of claim 8 wherein the rotation of the seed roll retaining member is limited to rotation between the first fully-retracted position and one or more of said plurality of intermediate positions when the breast is in the ginning position.

10. The saw type gin stand of claim 1 wherein the roll box further comprises a plurality of inwardly facing surfaces, at least two of said inwardly facing surfaces movably adapted to re-shape the roll box during ginning operations.

11. The saw type gin stand of claim 1 wherein the roll box further comprises an inwardly facing surface of a roll box door member, said door member operatively connected to a means for moving and holding the roll box door member between a fully-opened position and a fully-closed position.

12. A gin saw stand comprising:

(a) a main gin frame supporting a gin saw cylinder, said gin saw cylinder having a plurality of spaced apart parallel circular blades having serrated edges rotating about a central axis;

(b) a breast attached to the main gin frame, said breast movable between a closed position and an open position;

(c) said breast supporting a plurality of ginning ribs positionable between said plurality of blades;

(d) a roll box structure forming a somewhat distorted cylindrical roll box adjacent to said gin saw cylinder;

(e) an inner surface of a seed roll retaining member forming a segment of said roll box structure, said seed roll retaining member having a proximal end attached to the breast at a pivot point and an elbow end opposite said pivot point;

(f) the elbow end of the seed roll retaining member positionable to a distance of about 2.4 cm from the serrated edges of the blades of the gin saw cylinder when the breast is in the closed position; and (g) the elbow end of the seed roll retaining member positionable to a distance of about 5.1 cm from the ginning ribs when the breast is in the open position.

13. The gin saw stand of claim 12 wherein the elbow end of the seed roll retaining member is positionable to a distance of about 10.2 cm from the ginning ribs when the breast is in the open position.

14. The gin saw stand of claim 12 wherein the elbow end of the seed roll retaining member is positionable to a distance of about 3.8 cm from the serrated edges of the blades of the gin saw cylinder when the breast is in the closed position.

15. The gin saw stand of claim 12 wherein said seed roll retaining member is operatively connected to a cam shaft assembly for moving the seed roll retaining member during ginning operations.

16. The gin saw stand of claim 12 wherein the seed roll retaining member further comprises a distal end extending from the elbow end, said distal end in slidable contact with the breast.

17. The saw type gin stand of claim 16 wherein one or more supports are spaced along the length of the seed roll retaining member between the proximal end and distal end to maintain the shape of the seed roll retaining member.

18. The gin saw stand of claim 12 further comprising a cam shaft transversely spanning the breast substantially parallel to the axis of the saw cylinder and one or more cams carried upon the cam shaft, each such cam in slidable contact with the seed roll retaining member.

19. A saw type gin stand for separating cotton lint from seed cotton comprising a gin saw cylinder having a plurality of spaced apart parallel circular blades rotating about a central axis, ginning ribs between said blades, a roll box comprising a plurality of inwardly facing surfaces, said roll box adjacent to said gin saw cylinder, wherein at least two of said inwardly facing surfaces are movably adapted to re-shape the roll box.

20. The saw type gin stand of claim 19 wherein said movably adapted inwardly facing surfaces comprise an inner surface of a roll box door member.

21. The saw type gin stand of claim 20 further comprising a means for moving and holding the roll box door member between a fully-opened position and a fully-closed position.

22. The saw type gin stand of claim 19 wherein said movably adapted inwardly facing surfaces comprise an inner surface of a roll box door member, and an inner surface of a seed roll retaining member.

23. The saw type gin stand of claim 22 wherein said seed roll retaining member is pivotably attached to a breast of said gin stand at a pivot point and is rotatable about said pivot point between a first fully-retracted position, through a plurality of intermediate positions, to a second fully-extended position.

24. The saw type gin stand of claim 22 wherein said seed roll retaining member is rotatable through an arc of between about 20 degrees to about 40 degrees.

25. The saw type gin stand of claim 23 wherein said breast is positionable between an open position and a closed position and wherein said seed roll retaining member is rotatable between the first fully-retracted position and the second fully-extended position only when the breast is in the open position, and wherein said seed roll retaining member is rotatable between the first fully-retracted position and one or more of said plurality of intermediate positions but not the second fully-extended position when the breast is in the closed position.

26. The saw type gin stand of claim 22 wherein said seed roll retaining member further comprises a proximal end attached to said pivot point, an elbow end opposite said pivot point, and a distal end in slidable contact with the breast to block seed cotton from accumulating behind the seed roll retaining member.

27. A gin saw stand comprising:

(a) a main gin frame supporting a gin saw cylinder, said gin saw cylinder having a plurality of spaced apart parallel circular blades rotating about a central axis;

(b) a breast attached to the main gin frame, said breast movable between a closed, ginning position and an open position;

(c) said breast supporting a plurality of ginning ribs positionable between said plurality of blades;

(d) a roll box structure forming a somewhat distorted cylindrical roll box adjacent to said gin saw cylinder;

(e) an inner surface of a seed roll retaining member forming a segment of said roll box structure, said seed roll retaining member having opposing ends, one of said ends attached to the breast at a pivot point;

(f) said seed roll retaining member comprising a proximal end attached to said pivot point and an elbow end opposite said pivot point;

(g) a cam shaft assembly comprising a cam shaft transversely spanning the breast substantially parallel to the axis of the saw cylinder and one or more cams carried upon the cam shaft, each such cam in slidable contact with the seed roll retaining member;

(h) the elbow end of the seed roll retaining member positionable to a distance of about 2.4 cm from the serrated edges of the blades of the gin saw cylinder when the breast is in the closed, ginning position by means of said cam shaft assembly;

(i) the elbow end of the seed roll retaining member positionable to a distance of about 5.1 cm from the ginning ribs when the breast is in the open position.

28. A saw type gin stand for separating cotton lint from seed cotton comprising a gin saw cylinder having a plurality of spaced apart parallel circular blades rotating about a central axis, ginning ribs between said blades, a roll box adjacent to said gin saw cylinder, a movable breast positionable between a non-ginning position and a ginning position, said roll box further comprising an inner surface of a roll box door member, and a means for moving and holding the roll box door member between a fully-opened position and a fully-closed position.

29. The saw type gin stand of claim 28 wherein said means for moving and holding further comprises a pneumatic cylinder.

30. The saw type gin stand of claim 28 further comprising a seed roll retaining member attached to the breast substantially parallel to the axis of the saw cylinder, said seed roll retaining member extendable to within about 5 cm of the ginning ribs when the breast is in the non-ginning position.

* * * * *